US007810269B2

(12) United States Patent
Zukowski et al.

(10) Patent No.: US 7,810,269 B2
(45) Date of Patent: Oct. 12, 2010

(54) FRAME-MOUNTED TRIGGER SAFETY AND WELL EXTENSION

(75) Inventors: Gary E. Zukowski, Indian Orchard, MA (US); Sean O'Clair, Feeding Hills, MA (US); Brett Curry, Monson, MA (US)

(73) Assignee: Smith & Wesson Corp., Springfield, MA (US)

( * ) Notice: Subject to any disclaimer, the term of this patent is extended or adjusted under 35 U.S.C. 154(b) by 163 days.

(21) Appl. No.: 11/972,189

(22) Filed: Jan. 10, 2008

(65) Prior Publication Data

US 2008/0163531 A1 Jul. 10, 2008

Related U.S. Application Data

(60) Provisional application No. 60/884,310, filed on Jan. 10, 2007, provisional application No. 60/884,296, filed on Jan. 10, 2007.

(51) Int. Cl.
*F41A 17/00* (2006.01)

(52) U.S. Cl. ..... 42/70.01; 42/70.04; 42/70.05; 42/70.06

(58) Field of Classification Search ..... 42/70.01, 42/70.04, 70.05, 70.06
See application file for complete search history.

(56) References Cited

U.S. PATENT DOCUMENTS 5,903,994 A * 5/1999 Tange ..... 42/70.01
6,560,909 B2 * 5/2003 Cominolli ..... 42/70.05

* cited by examiner

*Primary Examiner*—Stephen M Johnson
*Assistant Examiner*—Daniel J Troy
(74) *Attorney, Agent, or Firm*—McCormick, Paulding & Huber LLP

(57) ABSTRACT

A trigger safety for a firearm having a frame and slide. The safety includes a safety assembly frame mountable within the firearm frame. The safety also includes at least one actuator operatively attached to the safety assembly frame, the actuator being capable of selectively moving the safety assembly frame between a first position and a second position. The assembly frame also has an abutment surface. In the first position the abutment surface contacts a trigger bar of the firearm preventing movement of the trigger and discharge of the firearm while allowing the slide to be cycled and in the second position the abutment surface is not in contact with the trigger bar and the firearm can be discharged.

14 Claims, 6 Drawing Sheets

FRAME-MOUNTED TRIGGER SAFETY AND WELL EXTENSION

CROSS-REFERENCE TO RELATED APPLICATIONS

This application claims priority to U.S. Provisional Application Nos. 60/884,310 and 60/884,296, both filed on Jan. 10, 2007, both hereby incorporated by reference in their entireties.

FIELD OF THE INVENTION

The present invention relates generally to a trigger safety for a firearm and more specifically to a frame-mounted safety for a pistol. The present invention also relates to a magazine well extension for a compact frame pistol facilitating the use of a full size magazine.

BACKGROUND OF THE INVENTION

Typically, pistol safeties are mounted either on the pistol slide or on the pistol frame. Slide-mounted pistol safeties generally allow a user to cycle the slide back to determine whether there is a round of ammunition in the chamber. Such safeties can be inconvenient to use, however, due to their location on the pistol. Frame-mounted safeties can be more user friendly as they are positioned so that they may be easily actuated with a user's thumb. Such safeties, however, generally do not allow the pistol slide to move and, accordingly, do not allow a user to determine if there is a round of ammunition in the chamber.

In addition, compact frame pistols typically have a magazine capacity of less than their full size counterpart, due to a shorter frame. In contrast, full size pistols, which have a larger frame and magazine well, can hold significantly more rounds of ammunition. In certain applications, it is desirable to have a full size magazine capacity in a compact frame pistol.

Previous attempts to address this issue have involved adding a collar directly to the magazine itself. The disadvantage of this approach, however, is that once the collar is placed on the magazine, it is quite difficult to remove. Moreover, once the collared magazine has emptied, a user might not have the time to remove the collar to place it on another full size magazine.

In view of the above, there is a need for a magazine well extension that facilitates the use of a full size magazine with a compact frame pistol. There is an additional need for a magazine well extension that is easily removed and does not involve placing an extension on the magazine itself. Moreover, there is a need for a frame-mounted safety that allows an operator to cycle the pistol slide to determine whether there is ammunition in the chamber.

SUMMARY OF THE INVENTION

It is an object of the present invention to provide a frame-mounted trigger block.

It is an additional object of the present invention to provide a frame-mounted safety that allows a user to determine whether there is ammunition in the chamber.

It is an additional object of the present invention to provide a pistol with a frame-mounted safety that allows a user to cycle the pistol slide to determine whether there is a round of ammunition in the chamber.

It is an object of the present invention to provide a magazine well extension for a pistol.

It is another object of the present invention to provide a magazine well extension for a pistol.

It is an additional object of the present invention to provide a magazine well extension for a compact frame pistol.

It is yet another object of the present invention to provide a magazine well extension for a compact frame pistol that facilitates the use of a full size magazine.

It is an additional object of the present invention to provide a magazine well extension for a pistol that may be easily removed from the pistol frame.

It is another object of the present invention to provide a magazine well extension for a compact pistol that allows multiple full size magazines to be loaded and discharged without having to remove the extension.

An embodiment of the present invention is a trigger safety for a firearm having a frame and slide. The safety includes a safety assembly frame which is mountable within the firearm frame. The safety also includes at least one actuator operatively attached to the safety assembly frame, the actuator being capable of selectively moving the safety assembly frame between a first position and a second position. The assembly frame also has an abutment surface. In the first position the abutment surface contacts a trigger bar of the firearm preventing movement of the trigger and discharge of the firearm while allowing the slide to be cycled and in the second position the abutment surface is not in contact with the trigger bar and the firearm can be discharged.

An additional embodiment of the present invention is a magazine well extension for a firearm having a frame. The well extension is for selective attachment to a grip of the firearm. The extension has a bore shaped to receive a firearm magazine, a locking mechanism for securing the extension to a distal end portion of the grip. Wherein the extension facilitates the attachment and use of a high capacity magazine to a compact firearm.

These and other objects of the present invention, and their preferred embodiments, shall become clear by consideration of the specification and drawings taken as a whole

DETAILED DESCRIPTION OF THE PREFERRED EMBODIMENT

Figure 1:
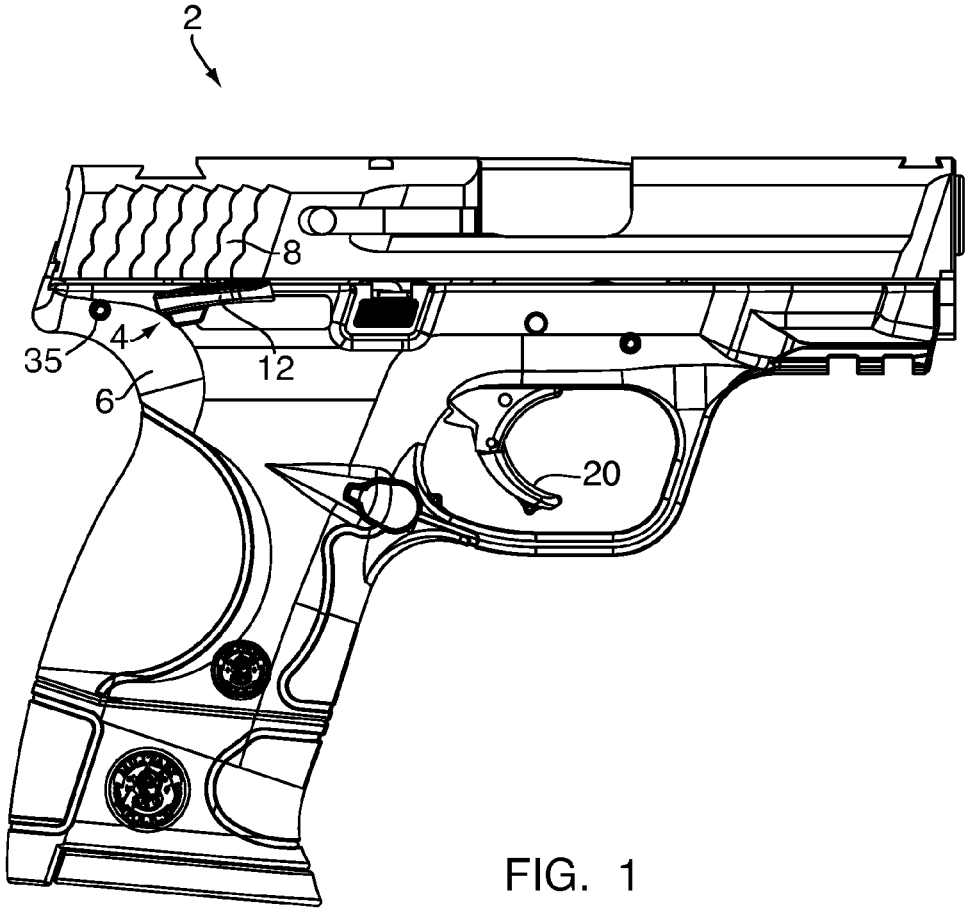
FIG. 1 is a side view of a pistol with a safety made in accordance with an embodiment of the present invention.

FIG. 1 shows a pistol 2 with a safety 4 made in accordance with an embodiment of the present invention. As depicted, the safety 4 is mounted on the pistol frame 6 and not on the slide 8. The safety 4 has two thumb actuators 12 which protrude from both sides of the pistol frame 6. The actuators 12 are raised to engage the safety and lowered to disengage the safety so that the pistol may be discharged.

As will be appreciated, the positioning of the safety on the frame is an important aspect of the present invention as it is in close proximity to a user's thumb and may be conveniently raised or lowered. Moreover, the actuators 12 are on either side of the pistol such that the pistol 2 is ambidextrous, i.e., it may be used by either a left-handed or right-handed person.

In addition, positioning the safety on the frame provides an ease of manufacture and cost-savings not present with slide mounted safeties. With a slide-mounted safety, the metal slide must be machined to accept the safety and its external actuator. With frame-mounted safeties, particularly with polymer frame pistol, the safety may simply be dropped into a molded frame and pinned in place without machining.

Figure 2:
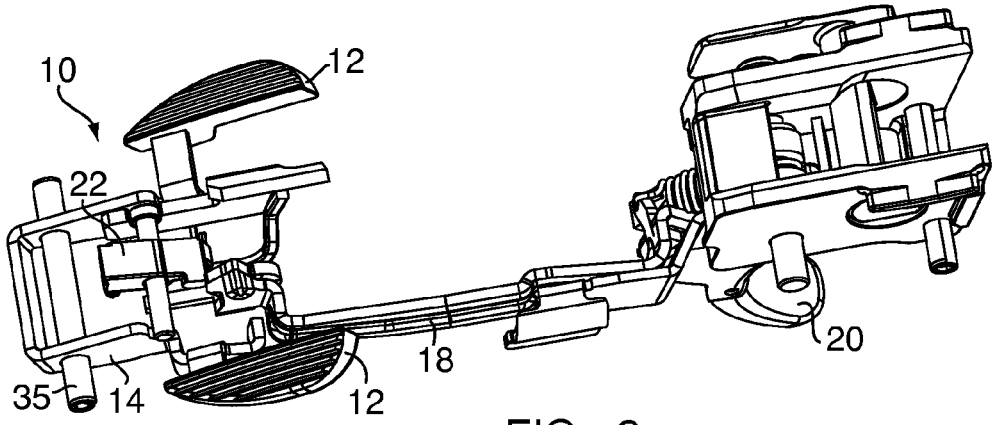
FIG. 2 is an enlarged perspective top view of the assembly, and related components, of the safety of FIG. 1.

Turning now to FIG. 2, the inventive safety 10 is shown along with related components including the trigger 20, trigger bar 18 and sear 22. The safety 10 includes thumb actuators 12 which are operatively connected to a safety assembly frame 14. The frame 14 includes an abutment surface 16. As will be described in greater detail herein, when the thumb actuator 12 is raised, the assembly frame 14 is tilted upward such that the abutment surface 16 is raised and contacts the trigger bar 18. When the abutment surface 16 contacts the trigger bar, trigger travel is limited such that the trigger 20 may not be pulled back and the pistol may not be discharged. This type of safety is known as a trigger block as it does not lock the sear 22 relative to the trigger, but limits travel of the trigger.

The inventive safety is described as working in connection with a firing mechanism in which the trigger urges a trigger bar rearward toward a user of the firearm. Such a firing mechanism is described in detail in U.S. Pat. No. 5,386,659 entitled "FIRE CONTROL MECHANISMS FOR SEMIAUTOMATIC PISTOLS", which is hereby incorporated in reference in its entirety. As will be appreciated, however, it may be possible for the inventive safety to be employed with other firing mechanisms.

Figure 3:
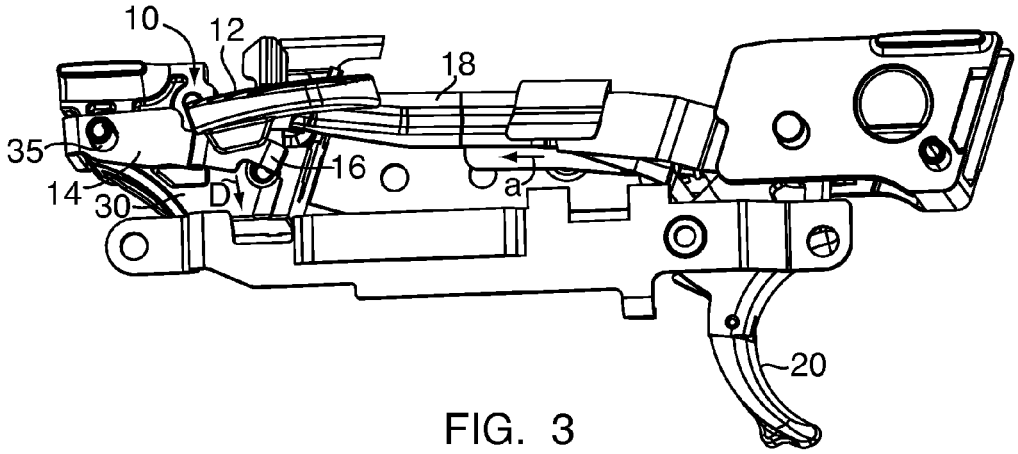
FIG. 3 is an enlarged side view of the safety assembly of FIG. 2 depicting the safety in an unlocked position.

Turning now to FIG. 3, the safety assembly 10 includes generally the thumb actuators 12 and frame 14. These components are housed with the sear housing block 30 of the firearm. More specifically, an end of the assembly frame 14 is pivotally secured to a rear portion (relative to the rear of the firearm) by a pin 35. As such, the unsecured end of the assembly frame 14 may be raised or lowered relative to the sear housing 30 and the firearm frame (not shown) into which the sear housing 30 is secured.

FIG. 3 depicts the inventive safety assembly 10 in a deactivated or unlocked position so that the pistol may be discharged. In this configuration, the abutment surface 16 of the safety assembly frame 14 is lowered in direction D until it is not in engagement with the trigger bar 18. In this position, the trigger 20 may be pulled back. When the trigger 22 is urged backward, the trigger bar 18 travels in direction a thereby releasing the sear and discharging the pistol.

Figure 4:
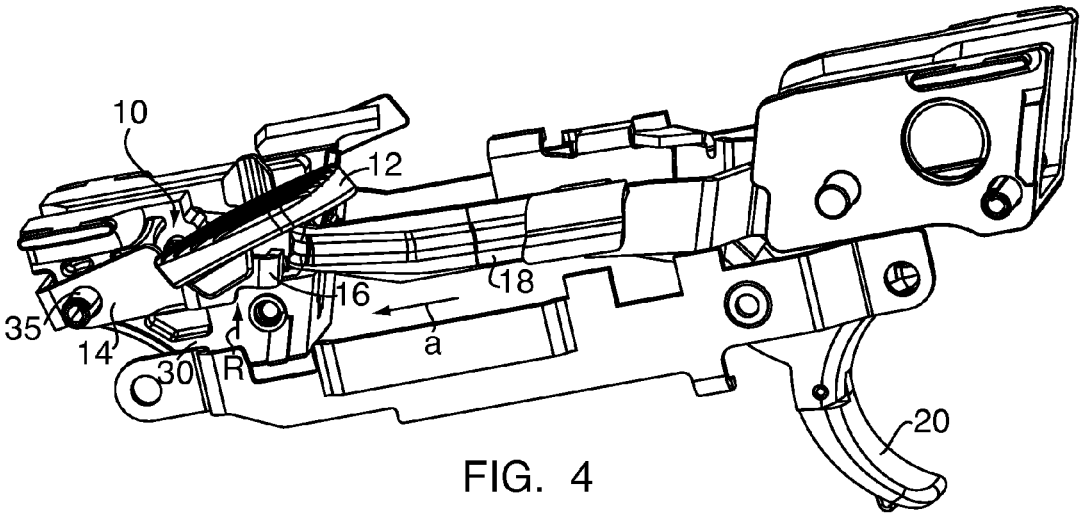
FIG. 4 is an enlarged perspective view of the safety assembly of FIG. 3 depicting the safety in a locked position.

Referring now to FIG. 4, the safety assembly 10 is shown in an activated or locked position so that the pistol may not be discharged. Here, the thumb actuator 12 has been raised in direction R, and the assembly frame 14 has tilted so that the abutment surface 16 now contacts the rear portion of the trigger bar 18. The trigger bar can no longer move backward in direction a and, accordingly, the trigger 20 (FIG. 2) cannot be pulled back. In this position, the sear 22 (FIG. 2) cannot be released and the pistol cannot be discharged.

As will be readily apparent, this is another important aspect of the present invention in that the above-described safety mechanism does not interfere with the movement of the slide. Indeed, the firearm is secured by limiting travel of the trigger bar, which in turn prevents movement and release of the sear. As such, the slide may be cycled and a user can determine whether a round is chambered.

Referring now to FIGS. 5A, 5B, 5C and 6, the safety assembly 10 is selectively securable in two above-described positions, i.e., a first, locked position and a second, unlocked position. These two positions correspond to first and second arcuate surfaces of the safety assembly frame. More specifically, a first arcuate surface 41 corresponds to a position where the assembly frame is lowered and the abutment surface 16 is not in contact with the trigger bar (not shown).

The second arcuate surface 43 corresponds to a position in which the assembly frame 14 is raised. In this position, the abutment surface engages the trigger bar prevent movement of the trigger and discharge of the gun.

Figure 5A:
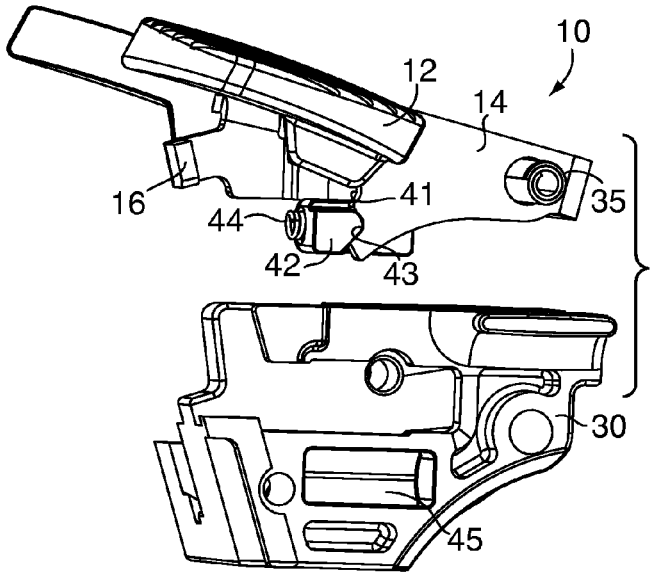
FIG. 5A is a perspective exploded view of the safety assembly of FIG. 2 and a sear housing block illustrating the interaction of protrusion and arcuate surfaces.
Figure 5B:
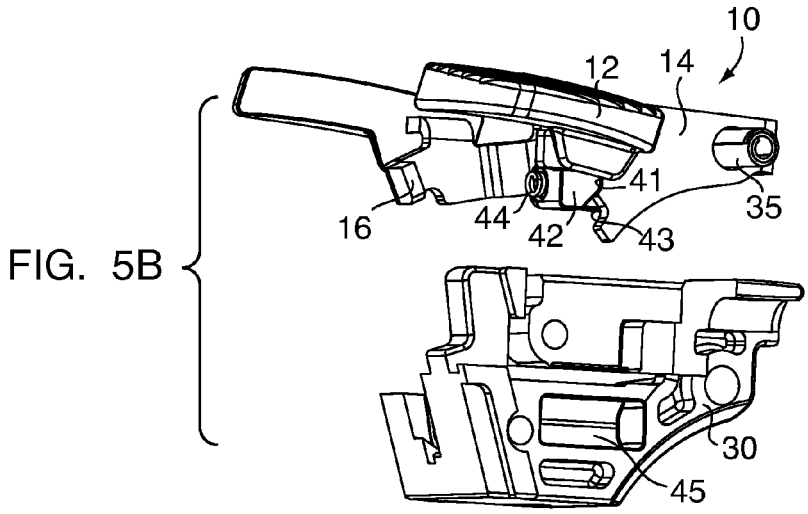
FIG. 5B is another perspective exploded view of the safety assembly of FIG. 2 and the sear housing block of FIG. 5A.

The assembly frame is secured in the locked or unlocked positions, through a biased protrusion 42 that matingly engages the arcuate surfaces of the assembly frame 14. This is illustrated in FIG. 5A, which depicts the protrusion 42 in mating engagement with the second arcuate surface 43. Likewise, FIG. 5B depicts the protrusion 42 in engagement with the first arcuate surface 41.

Figure 6:
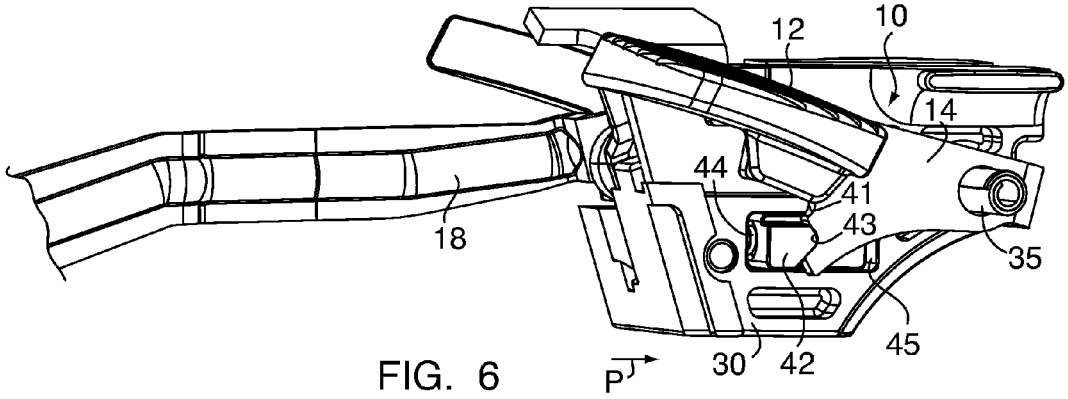
FIG. 6 is enlarged perspective side view of the safety assembly of FIG. 2 illustrating the safety assembly with the sear housing block and the interaction of protrusion and arcuate surfaces of a frame of the safety.

The protrusion 42 is biased by a spring 44 as illustrated. When assembled, the protrusion 42 is contained within a aperture 45 in the sear housing block 30. Referring to FIG. 6, the spring 44 urges the protrusion 42 toward the arcuate surfaces, in direction p, through the tension created by the abutment of the spring against an inner, forward wall of the aperture 45.

Figure 5C:
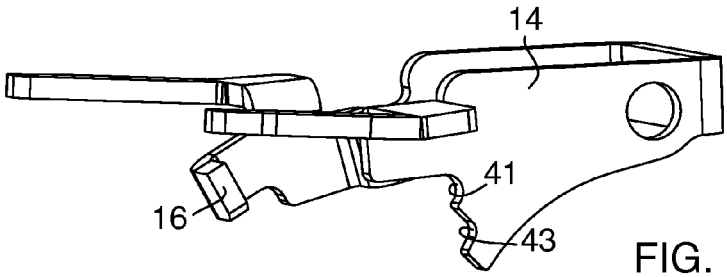
FIG. 5C is a enlarged, perspective view of a safety assembly frame of the present invention.

Additionally and significantly, the adjacent arcuate surfaces 41, 43 function as a mechanism where, if a user places the safety in an intermediate position, e.g., between a locked and unlocked state, the safety is biased to the locked position, e.g., into arcuate surface 43. As shown in FIG. 5C, this is accomplished, in part, through the shapes of the adjacent arcuate surfaces 41, 43. In particular, the ridge between surfaces 41 and 43 is shaped such that, if engaged by the protrusion 42 the slightly ramped profile of arcuate surface 43 will cause the protrusion 42 to locate in that arcuate surface 43, which corresponds to a locked trigger bar.

As will be appreciated, this is yet another important aspect of the present invention as it provides an additional level of safety. An intermediate position between locked and unlocked cannot be inadvertently selected and, if it is attempted, the safety defaults to a locked state.

Figure 7:
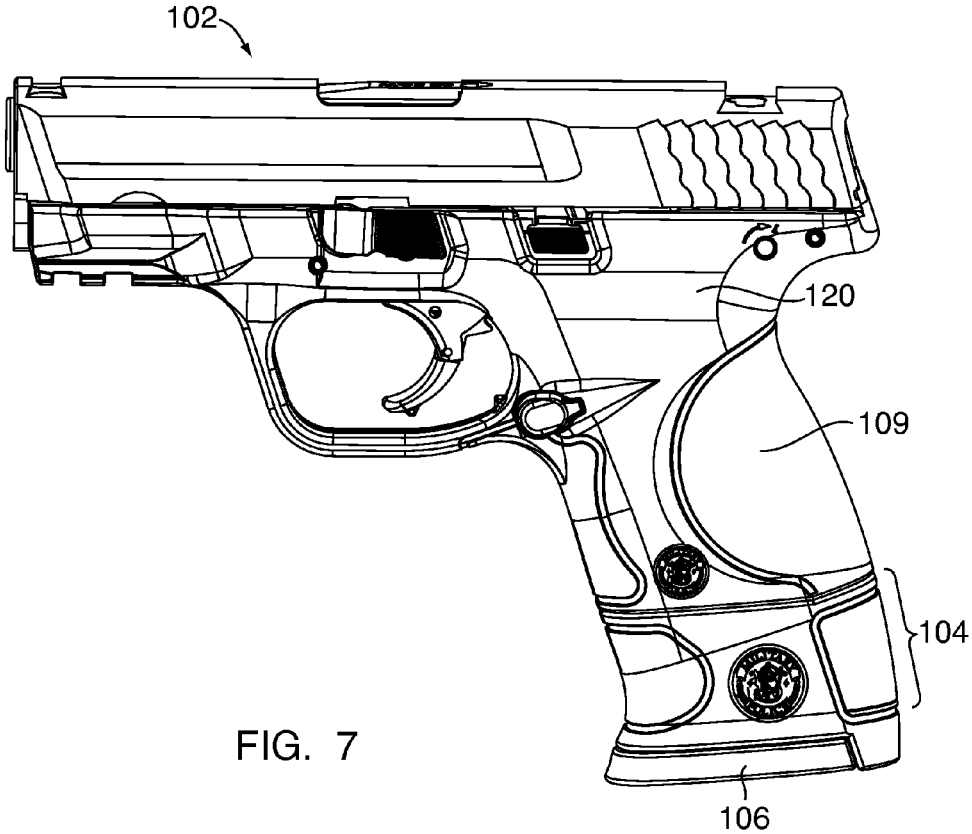
FIG. 7 is a side view of the pistol with an embodiment of the magazine well extension of the present invention.

FIG. 7 depicts a compact frame pistol 102 with the magazine well extension 104 according to an embodiment of the present invention. The magazine 106 is inserted through the well extension 104 and into the pistol frame magazine well.

As will be appreciated, the extension 104 allows for a full size magazine with a higher capacity to be used with a compact frame pistol. The extension may also have ergonomic benefits as it increases the size of the grip portion of the pistol 102. Moreover, the extension 104 is secured directly to the pistol 102, as opposed to the magazine, via a key 108. As such, the present invention overcomes drawbacks with known extensions which are mountable to directly to a magazine as opposed to a pistol frame.

Figure 8:
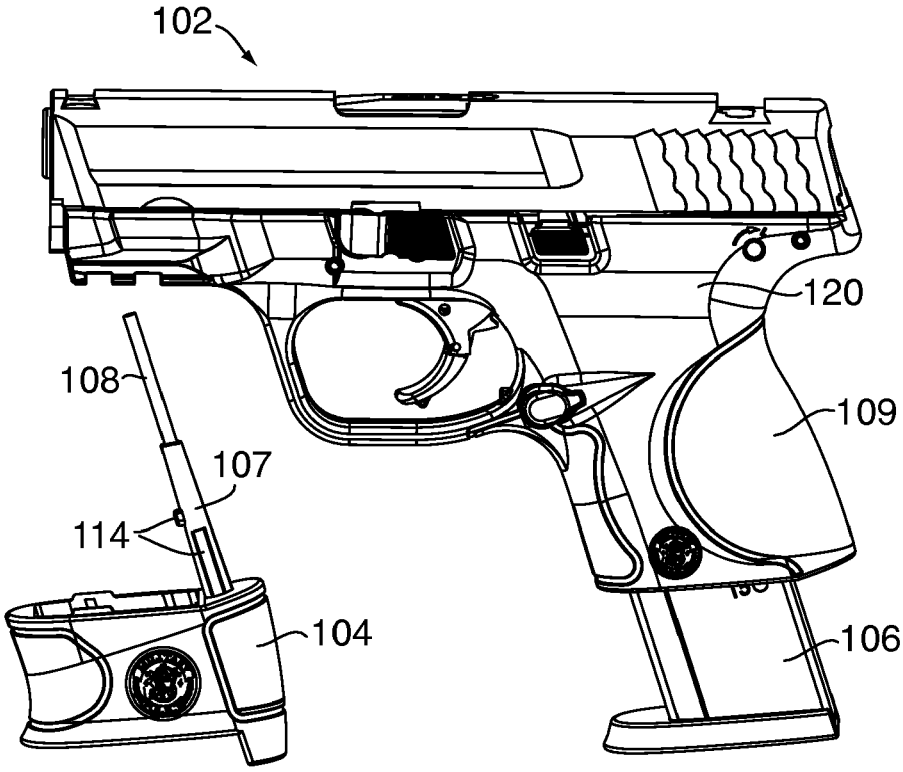
FIG. 8 is an exploded view of the pistol of FIG. 7.
Figure 9:
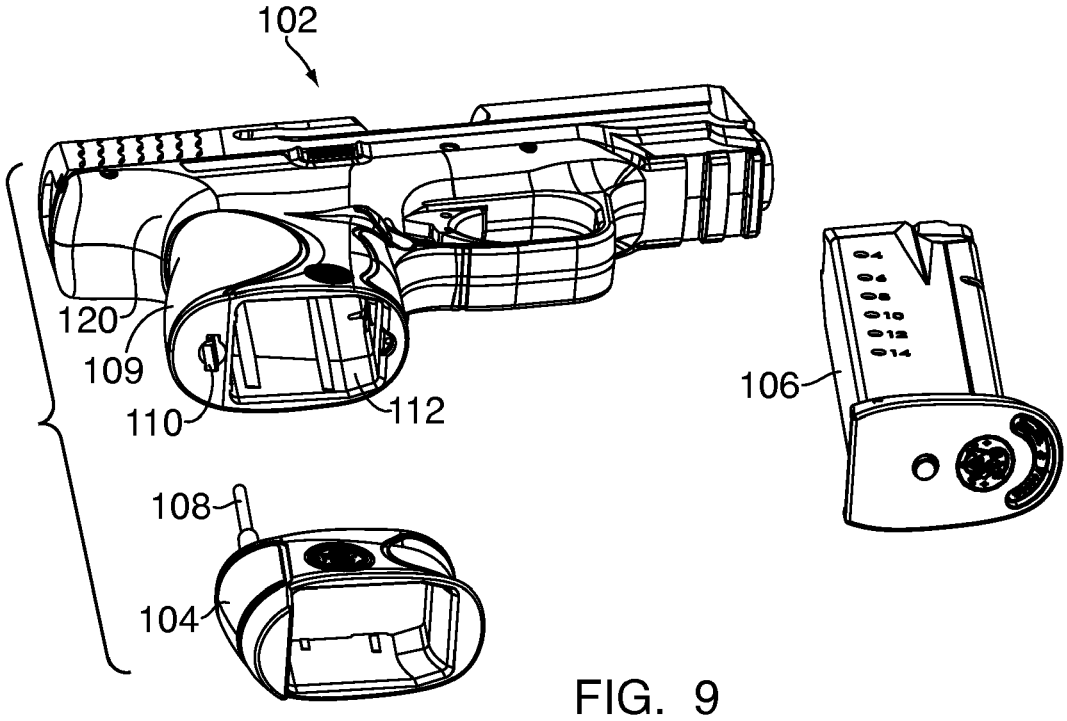
FIG. 9 is a perspective exploded view of the pistol of FIG. 8.
Figure 10:
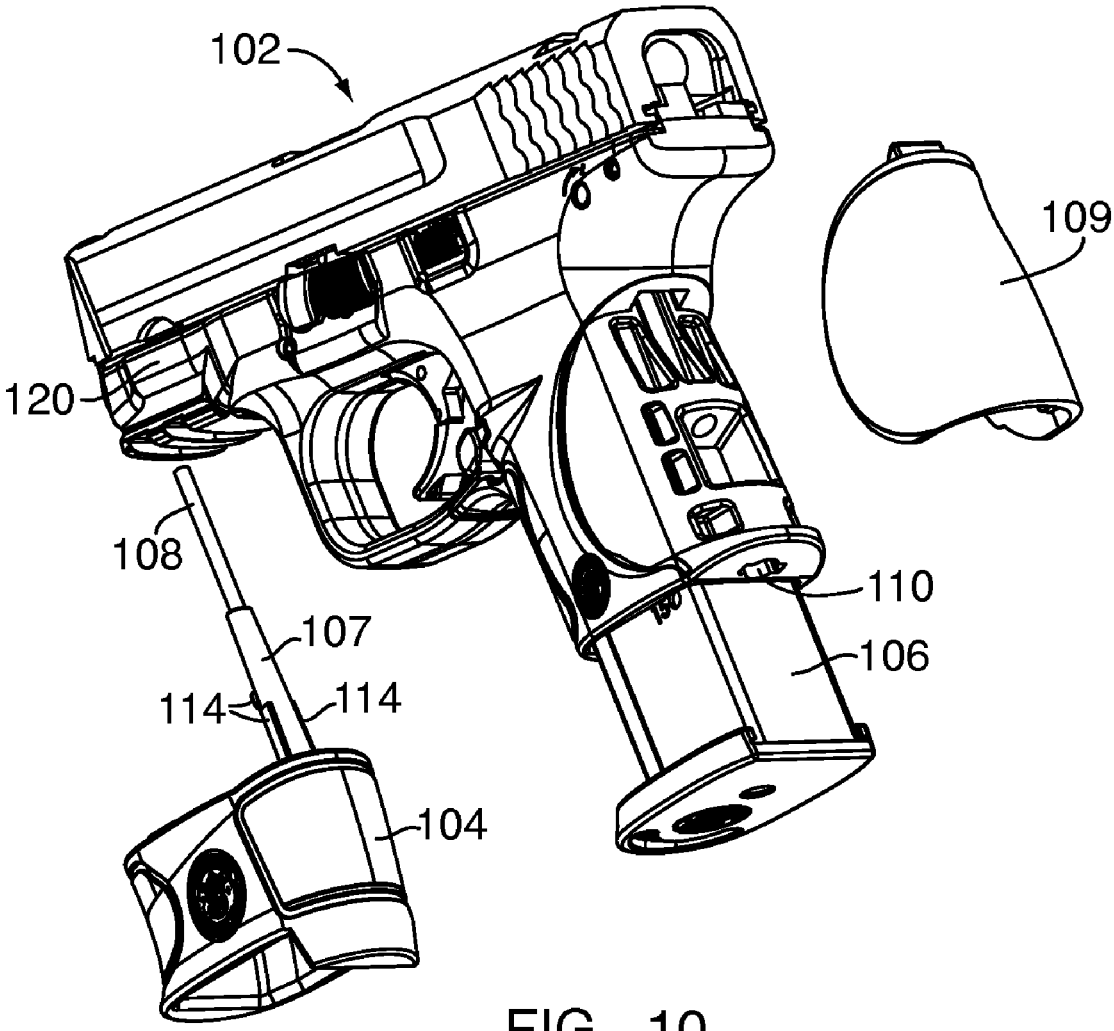
FIG. 10 is a rear perspective exploded view of the pistol of FIG. 9.

Turning now to FIGS. 8-10, the magazine well extension 104 has an elongated attachment portion 107 that allows the extension to be securely yet removably attached to the well 112 of the frame 120. The attachment portion 107 has a several protrusions 114 that fit into a corresponding receptacle 110 in the frame 120.

The frame tool or key 108 is inserted through an opening in the bottom of the well extension 104 and up through the attachment portion 107 of the extension 104 to secure both the extension 104 and grip strap 109 to the pistol grip. The frame tool or key 108 is described in greater detail in the Smith & Wesson, Safety & Instruction Manual for M&P Pistols, which is incorporated by reference in its entirety herein.

FIGS. 9 and 10 illustrate the relationship between the well extension 104, the attachment portion 107, the frame key 108 and the aperture 110 in the grip. To install the well extension 104, the grip strap 109 is first removed along with the key 108 that holds it locked in place. The well extension 104 is then added, turned and latched into the bottom of the frame and the grip strap 109 and key 108 are then reattached. A full size magazine 106 can now be inserted into the magazine well 112 through the extension 104.

As will be appreciated, this functionality allows a user to discharge multiple full size magazines without having to remove the extension. This overcomes a significant disadvantage of prior art magazine collars which attach directly to the magazine and are difficult to remove.

While preferred embodiments of the invention have been set forth for purposes of illustration, the foregoing description should not be deemed a limitation of the invention herein. Accordingly, portion of various modifications, adaptations and alternatives may occur to one skilled in the art without departing from the spirit and scope of the present invention.

What is claimed is:

1. A trigger safety for a firearm having a frame and slide, said safety comprising:

a substantially U-shaped safety assembly frame, said assembly frame being pivotally mounted within said firearm frame such that said safety assembly frame is rotatable relative to said firearm frame;

two actuators rigidly attached to said safety assembly frame on opposing legs of said U-shaped safety assembly frame, said actuators being capable of selectively rotating said safety assembly frame between a first position and a second position; and an abutment surface located on said safety assembly frame and extending intermediate said opposing legs of said U-shaped safety assembly frame;

wherein in said first position said abutment surface directly contacts a trigger bar of said firearm preventing movement of said trigger bar and discharge of said firearm while allowing said slide to be cycled and in said second position said abutment surface is not in contact with said trigger bar and said firearm can be discharged.

2. The trigger safety of claim 1 further comprising:

a housing, said safety assembly frame being pivotally attached to said housing.

3. The trigger safety of claim 2 further comprising:

a means for selectively securing said safety assembly frame in said first and second positions, said means being located within said housing.

4. The trigger safety of claim 3 wherein said means for selectively securing said safety assembly frame comprises:

a first arcuate surface in said safety assembly frame;

a second arcuate surface in said safety assembly frame a protrusion for selectively engaging said first and second arcuate surfaces; and a biasing mechanism urging said protrusion into engagement with either first or second arcuate surface, wherein when said protrusion is engaged with said first arcuate surface, said assembly frame is in said first position and when said protrusion is engaged with said second arcuate surface said assembly frame is in said second position.

5. The trigger safety of claim 4 wherein said first arcuate surface is shaped such that if said protrusion is set between said first and second positions said protrusion is urged into said first position preventing said firearm from being discharged.

6. The trigger safety of claim 4 wherein said biasing mechanism is an axially displaceable spring.

7. The trigger safety of claim 1 wherein said trigger assembly frame is substantially U-shaped.

8. The trigger safety of claim 1 wherein at least one actuator are two thumb controlled actuators, one actuator on a first side of said firearm and the other of said actuators on an opposite, second side of said firearm such that both left handed and right handed users may operate said trigger safety.

9. A firearm having a frame-mounted trigger safety, said firearm comprising:

a firearm frame;

a slide reciprocably secured to said firearm frame;

a trigger mechanism located within said firearm frame, said mechanism having a trigger and trigger bar;

a substantially U-shaped safety assembly frame pivotally mounted within said firearm frame such that said safety assembly frame is rotatable relative to said firearm frame, said assembly frame having an abutment surface rigidly attached thereto and extending intermediate opposing legs of said assembly frame, and at least one two actuators rigidly attached to said assembly frame on said opposing legs of said assembly frame, wherein said actuators can selectively rotate said assembly frame between a first position and a second position; and wherein in said first position said abutment surface directly contacts said trigger bar preventing movement of said trigger bar and discharge of said firearm while allowing said slide to be cycled, and in said second position said abutment surface is not in contact with said trigger bar and said firearm can be discharged.

10. The firearm of claim 9 further comprising:

a housing, said safety assembly frame being pivotally attached to said housing.

11. The firearm of claim 10 further comprising:

a means for selectively securing said safety assembly frame in said first and second positions, said means being located within said housing.

12. The firearm of claim 11 wherein said means for selectively securing said safety assembly frame comprises:

a first arcuate surface in said safety assembly frame;

a second arcuate surface in said safety assembly frame;

a protrusion for selectively engaging said first and second arcuate surfaces; and a biasing mechanism urging said protrusion into engagement with either first or second arcuate surface, wherein when said protrusion is engaged with said first arcuate surface, said assembly frame is in said first position and when said protrusion is engaged with said second arcuate surface said assembly frame is in said second position.

13. A firearm having a frame-mounted trigger safety, said firearm comprising:

a firearm frame;

a slide reciprocably secured to said firearm frame;

a trigger mechanism located within said firearm frame, said mechanism having a trigger and trigger bar;

a safety assembly frame pivotally mounted within said firearm frame such that said safety assembly frame is rotatable relative to said firearm frame, said assembly frame having an abutment surface and at least one actuator rigidly attached to said assembly frame, wherein said actuator can selectively rotate said assembly frame between a first position and a second position;

a housing, said safety assembly frame being pivotally attached to said housing;

a means for selectively securing said safety assembly frame in said first and second positions, said means being located within said housing, said means including first and second arcuate surfaces in said safety assembly frame, a protrusion for selectively engaging said first and second arcuate surfaces, a ridge between said first arcuate surface and said second arcuate surface, and a biasing mechanism urging said protrusion into engagement with either said first or said second arcuate surface;

wherein when said protrusion is engaged with said first arcuate surface, said assembly frame is in said first position and when said protrusion is engaged with said second arcuate surface said assembly frame is in said second position;

wherein said ridge is shaped such that if said protrusion is set between said first and second positions said protrusion is urged into said second position preventing said firearm from being discharged; and wherein in said second position said abutment surface contacts said trigger bar preventing movement of said trigger and discharge of said firearm while allowing said slide to be cycled, and in said first position said abutment surface is not in contact with said trigger bar and said firearm can be discharged.

14. The firearm of claim 13 wherein said biasing mechanism is an axially displaceable spring.

* * * * *